US010825410B2

(12) United States Patent
Leroux

(10) Patent No.: US 10,825,410 B2
(45) Date of Patent: Nov. 3, 2020

(54) ADDRESSING MODE AND PRINCIPLE FOR CONSTRUCTING MATRIX SCREENS FOR DISPLAYING COLOUR IMAGES WITH QUASI-STATIC BEHAVOUR

(71) Applicant: LRX INVESTISSEMENT, Bavent (FR)

(72) Inventor: Thierry Leroux, Bavent (FR)

(73) Assignee: LRX INVESTISSEMENT, Bavent (FR)

( * ) Notice: Subject to any disclaimer, the term of this patent is extended or adjusted under 35 U.S.C. 154(b) by 0 days.

(21) Appl. No.: 16/465,840

(22) PCT Filed: Dec. 1, 2016

(86) PCT No.: PCT/FR2016/053165

§ 371 (c)(1),
(2) Date: May 31, 2019

(87) PCT Pub. No.: WO2018/100252

PCT Pub. Date: Jun. 7, 2018

(65) Prior Publication Data

US 2019/0304390 A1 Oct. 3, 2019

(51) Int. Cl.
*G09G 3/36* (2006.01)
*G09G 3/3216* (2016.01)
(Continued)

(52) U.S. Cl.
CPC ..... *G09G 3/3625* (2013.01); *G09G 3/2085* (2013.01); *G09G 3/30* (2013.01);
(Continued)

(58) Field of Classification Search
CPC ..... G09G 3/3625; G09G 3/2085; G09G 3/30; G09G 3/3216; G09G 2300/08; G09G 2330/028
See application file for complete search history.

(56) References Cited

U.S. PATENT DOCUMENTS 5,812,105 A 9/1998 Van de Ven
6,618,031 B1 * 9/2003 Bohn, Jr. ..... H05B 45/37 345/83

(Continued)

FOREIGN PATENT DOCUMENTS

CN 101894504 A 11/2010
EP 1628285 A1 2/2006

(Continued)

OTHER PUBLICATIONS

Introduction to Driving LED Matrices, AV023697EN—Jul. 11, 2013, Avago Technologies, US, pp. 1-15.

*Primary Examiner* — Priyank J Shah
(74) *Attorney, Agent, or Firm* — Bachman & LaPointe, P.C.

(57) ABSTRACT

A matrix screen for displaying multiplexed colour images, wherein the screen comprises several selection modules each connected to at least one colour source, in that each selection module comprises different selection terminals, a single selection terminal per selection module being activated during the same screen operating phase or sub-frame, and in that the optoelectronic devices of the screen belonging to the same colour family.

11 Claims, 19 Drawing Sheets

(51) Int. Cl.
*G09G 3/30* (2006.01)
*G09G 3/20* (2006.01)

(52) U.S. Cl.
CPC ..... *G09G 3/3216* (2013.01); *G09G 2300/06* (2013.01); *G09G 2330/025* (2013.01); *G09G 2330/028* (2013.01)

(56) References Cited

U.S. PATENT DOCUMENTS

| | | | | |
|---|---|---|---|---|
| 6,734,875 | B1 | 5/2004 | Tokimoto et al. | |
| 8,154,481 | B2 | 4/2012 | Lee et al. | |
| 8,456,093 | B2 * | 6/2013 | Vaananen ..... | G09G 3/3413 315/192 |
| 10,170,045 | B2 | 1/2019 | Yamanaka | |
| 2007/0152923 | A1 * | 7/2007 | Baik ..... | G09G 3/3233 345/76 |
| 2007/0262334 | A1 | 11/2007 | Chiang et al. | |
| 2013/0234175 | A1 | 9/2013 | Okada et al. | |

FOREIGN PATENT DOCUMENTS

| | | | |
|---|---|---|---|
| JP | 2002244619 | A | 8/2002 |
| JP | 2006119274 | A | 5/2006 |
| WO | 2015002010 | A1 | 1/2015 |

* cited by examiner

| | Color | $T_1$ | $T_2$ | $T_3$ |
|---|---|---|---|---|
| $G_{1,1}$ | Red | 1/3 | 0 | 0 |
| $G_{1,2}$ | Red | 0 | 1/3 | 0 |
| $G_{1,3}$ | Red | 0 | 0 | 1/3 |
| $G_{2,1}$ | Green | 1/3 | 0 | 0 |
| $G_{2,2}$ | Green | 0 | 1/3 | 0 |
| $G_{2,3}$ | Green | 0 | 0 | 1/3 |
| $G_{3,1}$ | Blue | 1/3 | 0 | 0 |
| $G_{3,2}$ | Blue | 0 | 1/3 | 0 |
| $G_{3,3}$ | Blue | 0 | 0 | 1/3 |
| $F_1$ | | 1/3 | 1/3 | 1/3 |
| $F_2$ | | 1/3 | 1/3 | 1/3 |
| $F_3$ | | 1/3 | 1/3 | 1/3 |

C = 3
N = 1

FIG. 5

| | $T_1$ | $T_2$ | $T_3$ |
|---|---|---|---|
| $F_1$ | 1 | 0 | 0 |
| $F_2$ | 0 | 1 | 0 |
| $F_3$ | 0 | 0 | 1 |

FIG. 6

F1

| | 1 | 2 | 3 | 4 | 5 | 6 |
|---|---|---|---|---|---|---|
| 1 | $G_{1,1,1}$ | $G_{1,1,2}$ | $G_{1,3,1}$ | $G_{1,3,2}$ | $G_{1,2,1}$ | $G_{1,2,2}$ |
| 2 | $G_{1,3,2}$ | $G_{1,2,1}$ | $G_{1,2,2}$ | $G_{1,1,1}$ | $G_{1,1,2}$ | $G_{1,3,1}$ |
| 3 | $G_{1,1,1}$ | $G_{1,1,2}$ | $G_{1,3,1}$ | $G_{1,3,2}$ | $G_{1,2,1}$ | $G_{1,2,2}$ |
| 4 | $G_{1,3,2}$ | $G_{1,2,1}$ | $G_{1,2,2}$ | $G_{1,1,1}$ | $G_{1,1,2}$ | $G_{1,3,1}$ |
| 5 | $G_{1,1,1}$ | $G_{1,1,2}$ | $G_{1,3,1}$ | $G_{1,3,2}$ | $G_{1,2,1}$ | $G_{1,2,2}$ |
| 6 | $G_{1,3,2}$ | $G_{1,2,1}$ | $G_{1,2,2}$ | $G_{1,1,1}$ | $G_{1,1,2}$ | $G_{1,3,1}$ |

F2

| | 1 | 2 | 3 | 4 | 5 | 6 |
|---|---|---|---|---|---|---|
| 1 | $G_{2,2,1}$ | $G_{2,2,2}$ | $G_{2,1,1}$ | $G_{2,1,2}$ | $G_{2,3,1}$ | $G_{2,3,2}$ |
| 2 | $G_{2,1,2}$ | $G_{2,3,1}$ | $G_{2,3,2}$ | $G_{2,2,1}$ | $G_{2,2,2}$ | $G_{2,1,1}$ |
| 3 | $G_{2,2,1}$ | $G_{2,2,2}$ | $G_{2,1,1}$ | $G_{2,1,2}$ | $G_{2,3,1}$ | $G_{2,3,2}$ |
| 4 | $G_{2,1,2}$ | $G_{2,3,1}$ | $G_{2,3,2}$ | $G_{2,2,1}$ | $G_{2,2,2}$ | $G_{2,1,1}$ |
| 5 | $G_{2,2,1}$ | $G_{2,2,2}$ | $G_{2,1,1}$ | $G_{2,1,2}$ | $G_{2,3,1}$ | $G_{2,3,2}$ |
| 6 | $G_{2,1,2}$ | $G_{2,3,1}$ | $G_{2,3,2}$ | $G_{2,2,1}$ | $G_{2,2,2}$ | $G_{2,1,1}$ |

F3

| | 1 | 2 | 3 | 4 | 5 | 6 |
|---|---|---|---|---|---|---|
| 1 | $G_{3,3,1}$ | $G_{3,3,2}$ | $G_{3,2,1}$ | $G_{3,2,2}$ | $G_{3,1,1}$ | $G_{3,1,2}$ |
| 2 | $G_{3,2,2}$ | $G_{3,1,1}$ | $G_{3,1,2}$ | $G_{3,3,1}$ | $G_{3,3,2}$ | $G_{3,2,1}$ |
| 3 | $G_{3,3,1}$ | $G_{3,3,2}$ | $G_{3,2,1}$ | $G_{3,2,2}$ | $G_{3,1,1}$ | $G_{3,1,2}$ |
| 4 | $G_{3,2,2}$ | $G_{3,1,1}$ | $G_{3,1,2}$ | $G_{3,3,1}$ | $G_{3,3,2}$ | $G_{3,2,1}$ |
| 5 | $G_{3,3,1}$ | $G_{3,3,2}$ | $G_{3,2,1}$ | $G_{3,2,2}$ | $G_{3,1,1}$ | $G_{3,1,2}$ |
| 6 | $G_{3,2,2}$ | $G_{3,1,1}$ | $G_{3,1,2}$ | $G_{3,3,1}$ | $G_{3,3,2}$ | $G_{3,2,1}$ |

FIG. 13

ADDRESSING MODE AND PRINCIPLE FOR CONSTRUCTING MATRIX SCREENS FOR DISPLAYING COLOUR IMAGES WITH QUASI-STATIC BEHAVOUR

BACKGROUND

The present invention concerns an addressing mode and a principle for the construction of flat large-size colour matrix displays, and provides solutions to several disadvantages related to the current processes of implementation and addressing of these displays, observed mainly when the addressing of the image elements (in common language: pixels) of the said displays is said to be multiplexed, is carried out sequentially over time.

There are nowadays many techniques for making flat panel displays. Among them: Liquid crystal displays, which are the most common, plasma displays, organic light-emitting diode displays.

The main advantage of these flat panel display techniques over older techniques (screens using cathode ray tubes) is that their thickness, from a few millimetres to several centimetres, depends very little on the size of the screen, but essentially on the technique used.

The techniques mentioned above use collective manufacturing methods, all the pixels constituting the screen being made on a single substrate, usually glass, and whose size is now in practice limited to a diagonal measurement of a few meters.

Light-emitting diode displays overcome this limitation and usually use an assembly of unit components associated with their control electronics on a printed circuit board. The subsets thus constituted, or modules, of a size that can currently go up to 25 $dm^2$, are then combined to form very large modular screens. On the other hand, the resolution of these modules, and therefore of the screens that use them, is limited by the size of the components used to produce them, which is at least a few millimetres as the technology currently stands.

As an indication, documents US 2013/0234175[4] and US 2007/0262334[5] describe, without this being restrictive in the choices that the designer can make, LED components that could be used to manufacture a display of this type.

The latter technique is used to produce large screens that are usually observed from a large distance, such as urban or advertising display panels.

This invention applies, in particular, but not exclusively, to this last technique of screen construction.

The production of large screens by assembling sub-assemblies or modules is well described in the technical literature and, for example, in document [1] "Introduction to driving LED Matrices, AV02-3697EN—Jul. 11, 2013" published by Avago Technologies.

A structure widely used to create and control the different pixels of these modules is described in FIG. 17 of document [1] and FIG. 1 of the present document. This describes as an example four rows of two colour pixels 1 each composed of three sub-pixels red IA, green IB and blue 1C, in this case made of Red, Green and Blue light-emitting diodes (LEDs), and allowing to obtain images of any colour. This structure is repeated as many times as necessary to reach the number of rows, columns, and thus pixels, desired.

The matrix organization in pixel rows and columns is particularly suitable for displaying images and video content, due to the matrix organization of the images themselves. It is worth noting that the notion of rows and columns used in this document remains of pure form. The role of rows and columns, as these terms are used below, can be exchanged without changing the principle of the addressing modes and the principles of implementation described below.

Spatial Multiplexing

The addressing mode of such a structure uses a single circuit or module for selecting rows 2, successively activating them over time. In the example in FIG. 1, where the first pixel row shown is selected, the LED anodes of the same row are interconnected and receive the same positive control voltage generated by sub-assembly 3 when the switch of the row concerned is closed.

The LED cathodes of a same column of sub-pixels are connected to each other and to the same output of a control circuit chosen from the three possible outputs for the three possible sub-pixel colours, namely red 4A, green 4B and blue 4C. The current flowing in, and therefore the amount of light emitted by, a LED when the row to which it belongs is selected by the row selection circuit 2 and when the column to which it belongs is selected by the control circuit of sub pixels per colour, can therefore be controlled independently of the other LEDs in its own row and independently of the other LEDs in the unselected rows. The sequential selection of the screen rows thanks to the selection circuits 2, thus makes it possible to construct and display any image, in this case a white image resulting from the superposition of all the sub-pixels of the pixels of the same row on four successive sub-frames.

Depending on the implementation chosen, there may be, indifferently and without changing the operating principle, one such control circuit 4A, 4B or 4C per LED colour as described in FIG. 1, or only one circuit, for example, for the 6 LED columns. Many manufacturers offer suitable circuits that usually have 16 outputs and are able to temporally modulate the current flowing through the LEDs and thus produce images with a very large number of colour gradations. The data to be displayed are produced by sub-assembly 5 according to the specifications required by the manufacturer of the control circuit used.

The 4 lines of the screen section shown are selected successively in time, or, in this technique, multiplexed, which has the following consequences The displayed image is formed over a number of sub-frames depending on the number of rows on the screen of a display module that makes up the modular screen. The visual persistence of the human eye causes the 4 sub-images emitted by the LEDs of each row to overlap visually to produce a complete image.

Only one set of control circuits 4 is required to control the 4 rows.

The visual appearance of the 4 sub-images resulting from this addressing mode is described in FIG. 2 for a section of four by four pixels 1 of the screen, which specifies, for each of the 4 sub-frames T1 to T4, which are the selected pixels 6 displaying the status and colour determined by the content of the information transferred to and contained in the control circuits 4 and which are the non-selected pixels 7.

The sequence of sub-images thus produced must be fast enough so that the human eye does not perceive the independent sub-images. A repetition frequency greater than 25 Hz minimum is required.

It is said that such a structure has a multiplexing rate N=4 due to the number of sub-frames required to create a complete image. The most common multiplexing rates encountered in LED displays are 2, 4 and more rarely 8.

The N sub-images produced being relative to N groups of different pixels, each group of pixels being made up of a row of pixels, the multiplexing is called spatial.

It can be seen that such an arrangement has the economic advantage of requiring only N times fewer control outputs than sub-pixel groups.

On the other hand, it has the disadvantage of requiring an instantaneous current N times higher per control output for the same visual effect. However, since this current is applied to N times fewer pixels, the current remains the same for each sub-frame.

In addition, since the image display is dynamic and consists of N separate and successive sub-images, if a photograph of the screen is taken with a device (movie or photographic camera) whose exposure time is of the same order of magnitude as the duration of a sub-frame, the image obtained may be that of a sub-image and not be representative of the complete image displayed. This phenomenon is very disadvantageous when the image of such a screen appears, for example, in shots or video recordings of a sporting event.

Time Division Multiplexing

A time division multiplexing of the colour, with the red, green and blue sub-pixels of the same pixel, representing the different colour components of the display screen, being sequentially displayed to produce the final image, can also be considered.

Documents [2] U.S. Pat. No. 5,812,105, and [3] U.S. Pat. No. 6,734,875 provide such addressing modes.

According to FIG. 3, a display of this type has pixels 1 arranged in a matrix and each consisting of different types of optoelectronic devices 1A, 1B, 1C respectively capable of diffusing different basic colours (red, green, blue) when electrical excitation is applied to them, each optoelectronic device 1A, 1B, 1C being connected on the one hand to an electrical excitation source corresponding to the colour it diffuses, called colour source 3A, 3B, 3C, and on the other hand to a control means 5 allowing the diffusion intensity of the corresponding colour to be varied.

More precisely, optoelectronic devices IA, ID, 1E diffusing the same colour (in this case red for LEDs referenced IA, ID, IE) are connected by their anode to the corresponding colour source 3A (in this case VRED) via a single selection module 2 (see FIGS. 26 to 31). The cathodes of the three LEDs constituting the three sub-pixels red IA, green IB and blue 1C of the same pixel 1 are connected to each other and controlled by a single 3A colour source of a colour selection module. The displaying of the image thus consists of the temporal superposition of the three components red, green and blue, corresponding to the three different types or families of sub-pixels. FIG. 4 describes the visual aspect of a 4 by 4 pixel section of the screen, described in FIG. 3, for each of the 3 sub-frames T1, T2 and T3 in order to display at the end of the three sub-frames, a white screen consisting of the superposition of the red, then green and then blue screens. Each selected pixel thus successively takes on a red 6A, green 6B or blue 6C colour, whose intensity is determined by the content of the information transferred to and contained in the control circuits 4 of FIG. 3, the sub-pixels of each colour component being successively selected by the selection circuit 2.

The main advantage of such colour multiplexing, where the sub-pixels are grouped into as many groups as possible base colours "C" (in this case 3), i.e. groups of sub-pixels of the same colour, is that the number of control outputs required is divided by C, C being usually equal to 3, the number of sub-pixels or colour LEDs constituting an elementary pixel.

Its disadvantages are similar to those encountered for spatial multiplexing. Indeed:

- The instantaneous current required to display a colour image will be C times greater than if no colour multiplexing is applied. Unlike the previous case, each family of sub-pixels is addressed consecutively and the necessary current is not constant for each sub-frame as can be seen in the table in FIG. 6.
- The image display is dynamic and any shot taken on the screen during operation can highlight one of the colour components produced. For example, and in the case of a three-colour screen, red, green and blue, a completely green, red or blue image may result from a shot with a short exposure time.

Document [3] also draws attention to the fact that the working voltages of LEDs generally depend on the colour emitted and that, in order to optimize the energy consumption of a screen, it is preferable to plan a different supply voltage per group associated with each family of sub-pixels or group of sub-pixels.

In this case, the time multiplexing of the colour described in documents [2] and [3] leads to the choice of distinct voltage sources for each group. FIG. 3 shows the resulting operating diagram. The peak currents required for each of these voltage sources are C times higher than if no colour multiplexing is applied, while the average current remains the same. This constraint leads to the need to oversize these voltage sources and to use more capable and expensive components.

It is possible to summarize these two types of multiplexing found in the literature as follows.

In the case of spatial multiplexing of N value:

- All pixels, and thus sub-pixels, are grouped into N groups successively activated during N sub-frames, producing N sub-images of the complete image which, due to the phenomenon of retinal persistence, allow it to be reproduced.
- Each output of control circuits 4 allows N groups of sub-pixels to be controlled.
- Selection circuits 2 have N sets of outputs, each associated with a sub-frame.

In the case of time multiplexing of C different colour components:

- All sub-pixels are divided into C groups successively activated during C sub-frames, producing for example the C colour components of the complete image which, due to the phenomenon of retinal persistence, allow it to be reproduced.
- Each output of the control circuits 4 controls C sub-pixels.

The two types of spatial and temporal multiplexing described above have the major disadvantage of requiring more instantaneous current than if no multiplexing was performed, and of displaying an image with visual artefacts when shooting this screen with a camera with short exposure time.

SUMMARY OF THE INVENTION

The purpose of this invention is to remedy the disadvantages of the known methods of implementation described above.

It applies to displays whose pixels are made from light-emitting diode (LED) components, but can also be applied to any matrix display, whether based on electroluminescence or any other electro-optical effect for which opacity, refractive index, absorption, luminescence or any other optical property can be modified by means of electrical excitation.

More precisely, the purpose of the present invention is a multiplexed colour image display matrix screen, the screen consisting of pixels arranged in a matrix and each consisting of different types of optoelectronic devices respectively capable of diffusing different basic colours when electrical excitation is applied to it, each optoelectronic device being connected on the one hand to an electrical excitation source corresponding to the colour it diffuses, called a colour source, and on the other hand to a control means making it possible to vary the intensity of the emission of the corresponding colour, the optoelectronic devices diffusing the same colour being connected to the corresponding colour source via at least one module for selecting a colour source.

According to the invention, the screen comprises several selection modules each connected to at least one colour source, each selection module comprising different selection terminals, only one selection terminal per selection module being activated during the same operating phase of the screen or sub-frame, and the optoelectronic devices of the screen belonging to the same colour family, i. e. diffusing the same colour, are distributed among different groups, and meet the following characteristics:

- the optoelectronic devices of the same group are all connected to the same corresponding colour selection terminal of the same selection module,
- the selection terminals of a group of each family can be activated simultaneously in order to activate optoelectronic devices diffusing all possible colours during the same sub-frame.

The invention may also provide for one and/or the other of the following aspects:

- optoelectronic devices of the same pixel and belonging to different groups are connected to the same control means
- for a number of base colours C, C being a positive integer, and a multiplexing rate N, N being a positive integer, the optoelectronic devices of a number of N pixel(s) are connected to the same control means
- in which, for a number of base colours C, C being a positive integer, and a multiplexing rate N, N being a positive integer, the screen has a total number of $N*C^2$ groups in which the optoelectronic devices of the screen are distributed and a total number of $N*C^2$ selection terminals connected respectively to the $N*C^2$ groups and distributed into a number C*N of selection modules
- in which the optoelectronic devices of the same group and connected to the same selection terminal are arranged according to a column and/or a row of the pixel matrix constituting the matrix screen, the optoelectronic devices connected to two different selection terminals among those activated simultaneously during the same sub-frame are arranged along two adjacent columns and/or rows
- the optoelectronic devices of different groups connected to different selection terminals among those activated simultaneously during the same sub-frame are arranged in periodic alternation from one group to another along the columns and/or along the rows of the matrix constituting the screen
- the horizontal pitch HP of the pixels along the rows of the screen and the vertical pitch VP of the pixels along the columns of the screen are such that $VP=\sqrt{3}/2\ HP$ and that any grouping of 3 neighbouring pixels forms an equilateral triangle.
- the basic colours of the screen are 3, C=3, and are respectively red, green and blue
- the basic colours of the screen are 4, C=4, and are respectively red, green, blue and white
- an optoelectronic device is a light-emitting diode whose anode is connected to the corresponding selection terminal and the cathode to the corresponding control means The invention also concerns a display device comprising one or more screens assembled together to form it, as defined above.

The invention also concerns a method of manufacturing the matrix screen for displaying multiplexed colour images, as above.

According to the invention, the method comprises:

- a step of wiring several selection modules each to at least one colour source,
- a step of wiring optoelectronic devices to the same corresponding colour selection terminal of the same selection module, these devices connected to the same selection terminal forming a group,
- a step of configuring the selection terminals of a group of each family that can be activated simultaneously in order to solicit optoelectronic devices that diffuse all possible colours during the same sub-frame.

According to a preferred embodiment, for a number of base colours C, C being a positive integer, and a multiplexing rate N, N being a positive integer, a total number of $N*C^2$ optoelectronic groups is constituted and the devices of the same group are connected to the same terminal, the screen being sized with a total number of $N*C^2$ selection terminals and a total number of C*N selection modules.

The device according to the invention may additionally have one and/or the other of the following characteristics:

- The sub-pixel groups $G_{X,Y,Z}$ are spatially organized so that, for any sub-frame $T_{Y,Z}$ considered, any grouping of consecutive N.C pixels, considered along a row and/or grouping of consecutive N.C pixels considered along a column of the screen, contains exactly C pixels of which one sub-pixel is selected and displayed, each of the C sub-pixels being chosen in a different family Fx among the C families of sub-pixels on the screen.

For any sub-frame $T_{Y,Z}$ considered among the possible N.C., the sub-pixel groups $G_{X,Y,Z}$ are spatially organized in such a way that any pixel for which a representative among the C sub-pixel families Fx is selected and displayed, is followed, along the rows or columns or the rows and columns of the screen, by N−1 pixels for which none of the sub-pixels is selected.

- The sub-pixel groups $G_{X,Y,Z}$ are organized temporally so that any pixel of which a representative, among the C sub-pixel families Fx, is selected and displayed during a considered sub-frame, does not have a sub-pixel selected and displayed during the following N−1 sub-frames.

In the particular case when C=3 & N=1, the following embodiment has particular advantages:

- All pixels in the same row, distributed along a horizontal pitch HP, are horizontally offset by a half-pitch HP/2 from the pixels in the previous or next row, The 9 sub-pixel groups $G_{X,Y}$ where $1 \leq X \leq 3$ and $1 \leq Y \leq 3$, are spatially organized in such a way that whatever the sub-frame $T_Y$ considered, any group of 3 neighbouring pixels displays a representative of each of the 3 sub-pixel families on the screen.

This may also be amended according to whether: The horizontal pitch HP of the pixels along the screen rows and the vertical pitch VP of the pixels along the screen columns are such that $$VP = \frac{\sqrt{3}}{2} HP$$

and that any grouping of 3 neighbouring pixels forms an equilateral triangle.

According to any of the previous embodiments and if C=3, it is advantageous that: The sub-pixels of the $F_1$, $F_2$ & $F_3$ families are red, green and blue respectively.

In the same way and if C=4: The sub-pixels of the $F_1$, $F_2$, $F_3$, $F_4$ families can be advantageously coloured red, green, blue and white, respectively.

The invention applies in particular to displays manufactured from light-emitting diodes. In this case:

All the anodes of the light-emitting diodes constituting the sub-pixels of a same group $G_{X,Y,Z}$ are connected to each other, Each output of the control circuits is connected to the C.N cathodes of the light-emitting diodes constituting the C.N sub-pixels of N distinct pixels, each sub-pixel belonging to a distinct $G_{X,Y,Z}$ group characterized by $1 \leq Y \leq C$ and $1 \leq Z \leq N$.

BRIEF DESCRIPTION OF THE DRAWINGS

FIG. 5 describes for a section of a tree-colour screen using the addressing method of the invention, the percentage of pixels activated by sub-pixel groups, for C=3 and N=1.

FIG. 6 describes the same situation using a method of the prior art from FIGS. 3 and 4.

FIG. 13 describes in relation to FIGS. 10 & 12, an example of how sub-pixel groups are organized along screen rows & columns & the family considered.

DEFINITIONS

Sub-pixel: optoelectronic device capable of diffusing a colour of the visible spectrum with a greater or lesser intensity, when an electrical excitation is applied to it; this will called indifferently sub-pixel or electronic device, light-emitting diodes or LEDs, in this text Sub-frame: the operating phase of a multiplexed matrix screen during which a degraded image (with fewer pixels enabled than the image to be displayed) is produced. For a multiplexing rate N, it will require a number of N successive sub-frames to reconstitute said image to be displayed.

DETAILED DESCRIPTION

The invention concerns a matrix screen with fewer visual artefacts than a prior art screen when filmed or captured by a camera with a short exposure time and which requires less instantaneous current than known multiplexed screens.

This objective is achieved through innovative wiring of the screen sub-pixels which are organized into different groups so that during each sub-frame, the sub-pixels of all the base colours of the screen are activated and that on average, during each sub-frame, ⅓ of the sub-pixels are activated.

In the following, with reference to FIG. 14, the innovative wiring according to the invention will be detailed for an example of embodiment, C=3, N=1:

In a conventional way, each pixel of screen 1 is made up of several sub-pixels that respectively diffuse the basic colours of the screen. In this example, there are three basic colours: red, green and blue, with this number noted as C. The red, green and blue sub-pixels are arranged in this order for each of the pixels represented.

The number N governs with the number of colours C, the number of sub-frames allowing the constitution of a complete image, which is equal to C*N or three sub-frames for the example shown.

Figure 12:
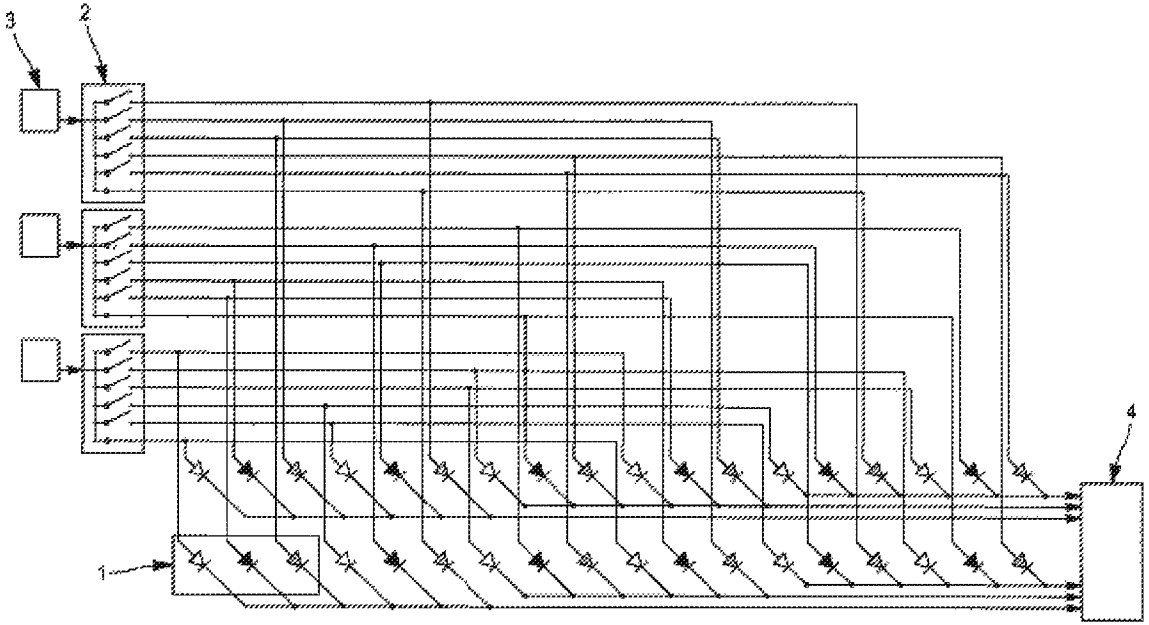
FIG. 12 describes an example of embodiment of the invention in the case where C=3 & N=2 and the sub-pixels are made of light-emitting diodes.
Figure 14:
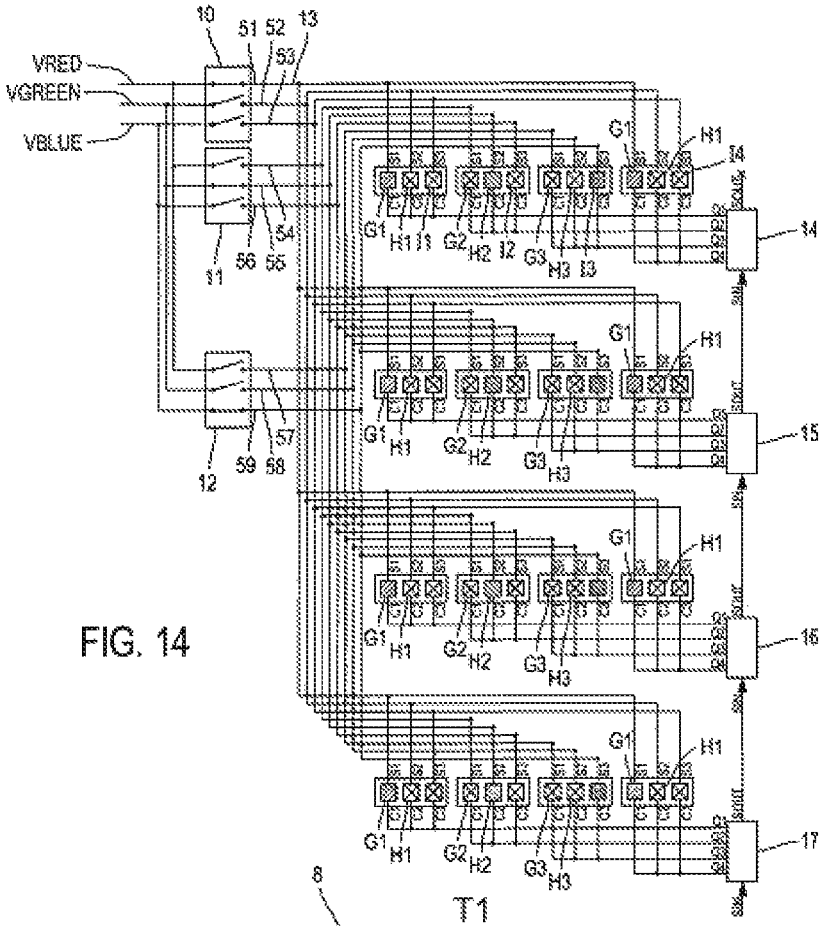
FIG. 14 schematically illustrates the wiring of the pixels of the screen whose sub-frames are shown in FIG. 8, for sub-frame T1 whose representation is also shown in FIG. 15

According to the invention and as shown in FIG. 14, the screen includes several selection modules 10, 11, 12 each connected to at least one VRED, VGREEN, VBLUE colour source. In the example of FIG. 14, each selection module is connected to all three colour sources. In the example of FIG. 12, each selection module 2 is connected to a single colour source.

Each selection module 10, 11, 12 includes different selection terminals 13, each connected to a colour source via a switch.

Concept of Sub-Pixel Group

The sub-pixels (which are light-emitting diodes in the example shown) are part of different colour families (red family $F_1$, green family $F_2$, blue family $F_3$) represented by different coloured squares and/or patterns.

The sub-pixels of a same family are divided into different groups recognizable by the fact that the sub-pixels belonging to the same group are connected to the same connection terminal.

According to the invention, the number of sub-pixel groups depends on the number of basic colours C on the screen, which are three in the example shown (red, green and blue), and a positive integer N representing the multiplexing rate which is 1 in the example shown.

More precisely, the number of sub-pixel groups is $N*C^2$ or 9 sub-pixel groups, each connected respectively to a number $N*C^2$ selection terminals, and each colour family includes a number of C*N or three sub-pixel groups of the same colour.

In other words, in the example shown, there are three groups of sub-pixels per colour family.

Thus, there are three groups of sub-pixels of red colour (hatched square in the first line of the caption) each linked to the selection terminal corresponding to its colour within a selection module:

- the first group G1 consists of the red sub-pixels of the first pixel column and the fourth pixel column (and all subsequent columns of the screen following this periodicity, not shown), these sub-pixels all being connected to the selection terminal SI which is connected to the red colour source in the first selection module 10
- the second group G2 consists of the red sub-pixels of the second pixel column (and all subsequent columns of the screen following the same periodicity, not shown) which are all connected to terminal S4 which is connected to the red colour source in the second module
- the third group G3 is made up of the red sub-pixels of the third pixel column (and all the following columns of the screen following the same periodicity, not shown) which are all connected to terminal S4 which is connected to the red colour source in the third module Similarly, there are three groups of green sub-pixels H1, H2 and H3, consisting of the green sub-pixels present respectively in:

- one column out of four from the 1st (sub-pixels referenced H1), which are all connected to selection terminal S2
- one column out of four from the 2nd (sub-pixels referenced H2) which are all connected to the selection terminal S5
- one column out of four from the 3rd (sub-pixels referenced H3) which are all connected to the selection terminal S8

And finally, there are three groups of blue-coloured sub-pixels (remaining sub-pixels partially referenced I), consisting of the blue sub-pixels present respectively in:

- one column out of four from the 1st (sub-pixels partially referenced I1) which are all connected to the selection terminal S3
- one column out of four from the 2nd (sub-pixels partially referenced I2) which are all connected to the selection terminal S6
- one column out of four from the 3rd (sub-pixels partially referenced I3) which are all connected to the selection terminal S9

The screen according to the invention includes a control box which controls the closing of one switch per selection module at each sub-frame, and thus connects the S terminal of a sub-pixel group to the corresponding colour source knowing that the switches whose closing is controlled are connected to different colour sources, so that at each sub-frame, all colours are diffused simultaneously.

Thus, at each sub-frame, the selection terminals of a group of each family can be activated simultaneously in order to activate optoelectronic devices diffusing all possible colours.

In the following sub-frames, the selection terminals of the other sub-pixel groups are activated, still ensuring that the groups of the three colour families are connected simultaneously.

In this case, as shown in FIG. 14 for the frame T1, the switches connected to the terminals S1, S5 and S9 (respectively connected to the red, green and blue colour sources) are closed, allowing the red G1, green H2 and blue I3 sub-pixel groups to be connected to their respective colour sources.

Figure 16:
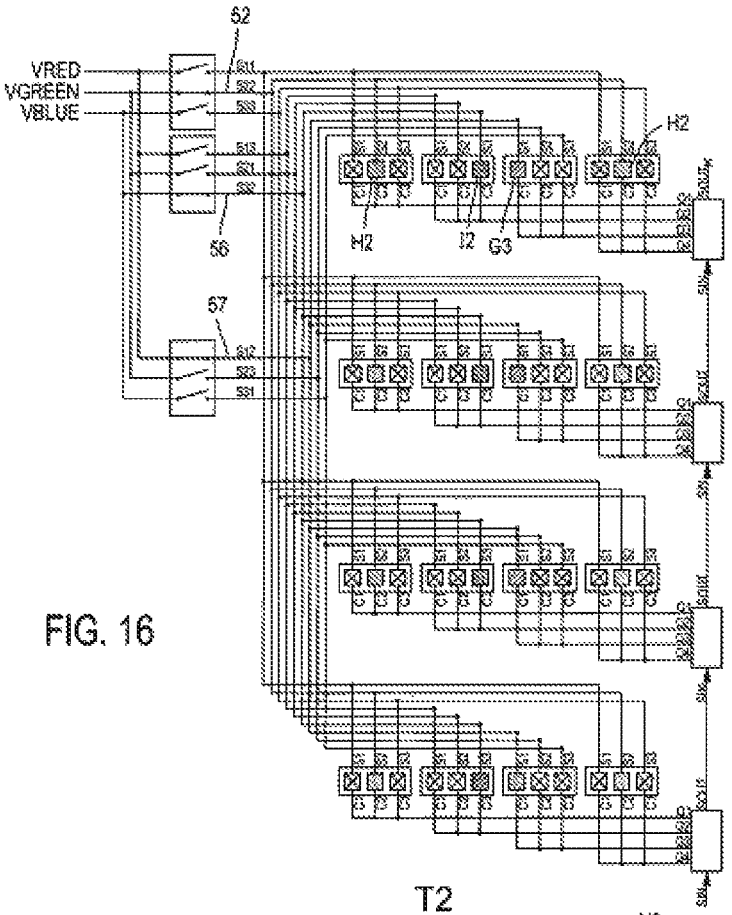
FIGS. 16 and 17 are similar to FIGS. 14 and 15, for sub-frame T2

In the next sub-frame T2, as shown in FIG. 16, it is terminals S2, S6 and S7 whose switches are closed to connect the green sub-pixel group H2, blue sub-pixel group 12, red sub-pixel group G3.

And in the next sub-frame T3, as shown in FIG. 16, it is terminals S3, S4 and S8 whose switches are closed to connect the green sub-pixel group H3, blue sub-pixel group I1, red sub-pixel group G2.

It is clear that at each sub-frame, sub-pixels of different colours, distributed over the entire screen (and no longer some rows of sub-pixels of the same colour) are potentially activatable.

To control their activation, control means are provided. Each sub-pixel is connected, opposite its selection terminal, to an output of a control means that can regulate the light diffusion intensity of that particular sub-pixel between 0 and 100%.

Since sub-pixels of the same pixel are never activated at the same time, the same control means output can control the sub-pixels of the same pixel. This is the case of the separate outputs of the control means 14 to 17 in FIG. 14, which are each connected to the sub-pixels of the same pixel, thus modulating the intensity of the sub-pixel activated during the sub-frame considered.

According to the invention, as will be explained for the case where N=2, for the cases where N>1, the same control means can advantageously control the sub-pixels of a number of N pixels that are not connected to selection terminals activated during the same sub-frame.

Figure 15:
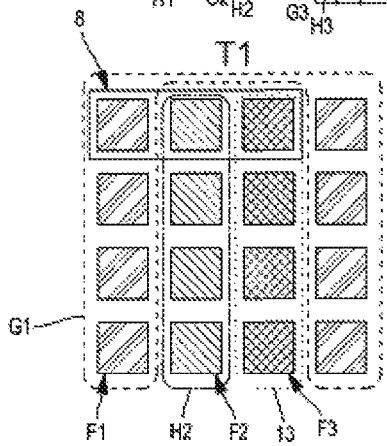
Figure 17:
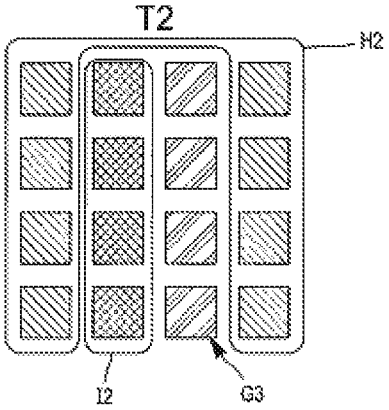
Figure 18:
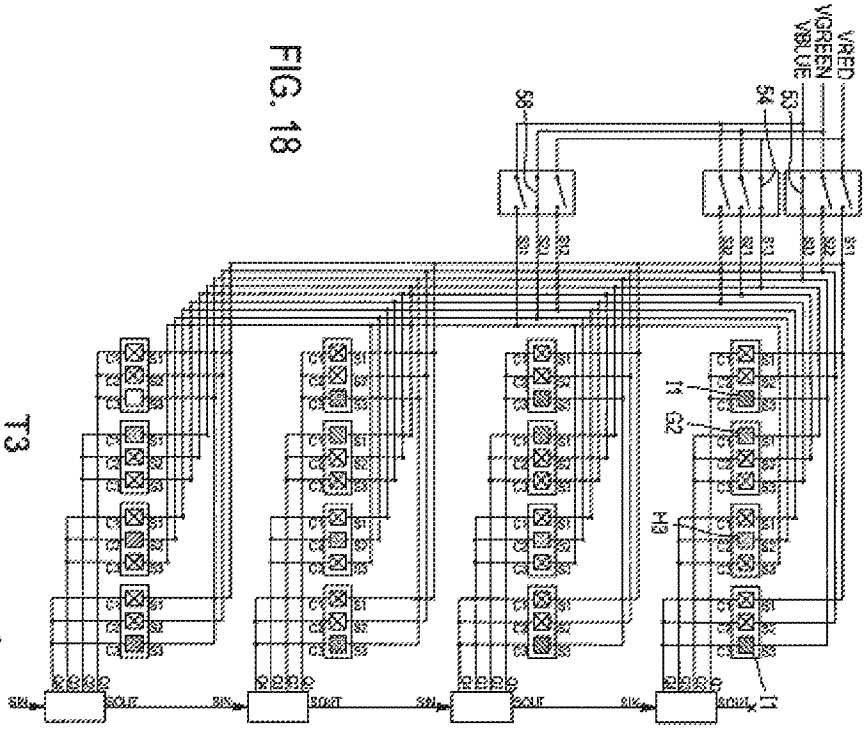
FIGS. 18 and 19 are similar to FIGS. 14 and 15, for sub-frame T3
Figure 19:
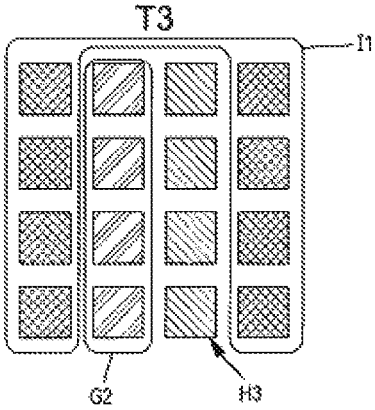

FIGS. 15, 17 and 19, which represent the three sub-frames of an image, illustrate the display of the screen when the control outputs control the active sub-pixels so that they all diffuse the corresponding colour at 100%.

At the end of these three sub-frames, a white screen is obtained, resulting from the superposition of the three colours displayed by each pixel successively.

Formation of any Image on the Screen According to the Invention

Figure 32:
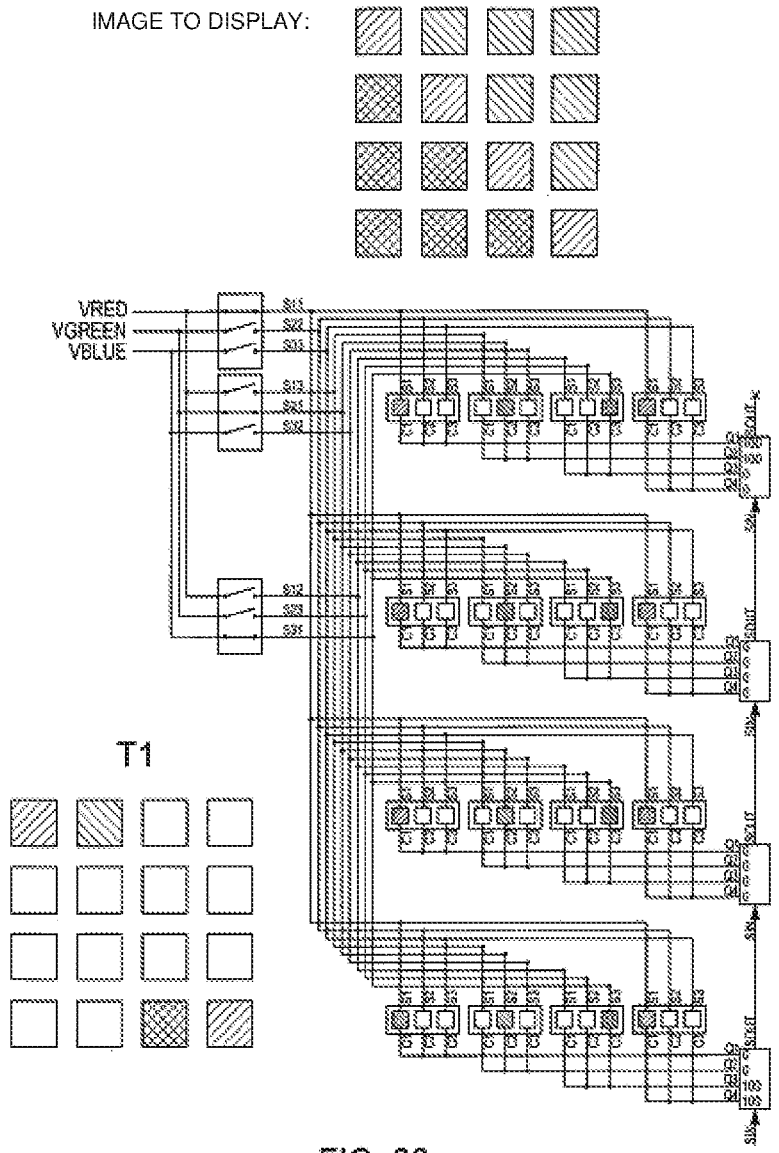
FIGS. 32 to 34 are similar to FIGS. 14 to 19 in that they are designed to illustrate the configuration of the control means for displaying any image on the screen.
Figure 33:
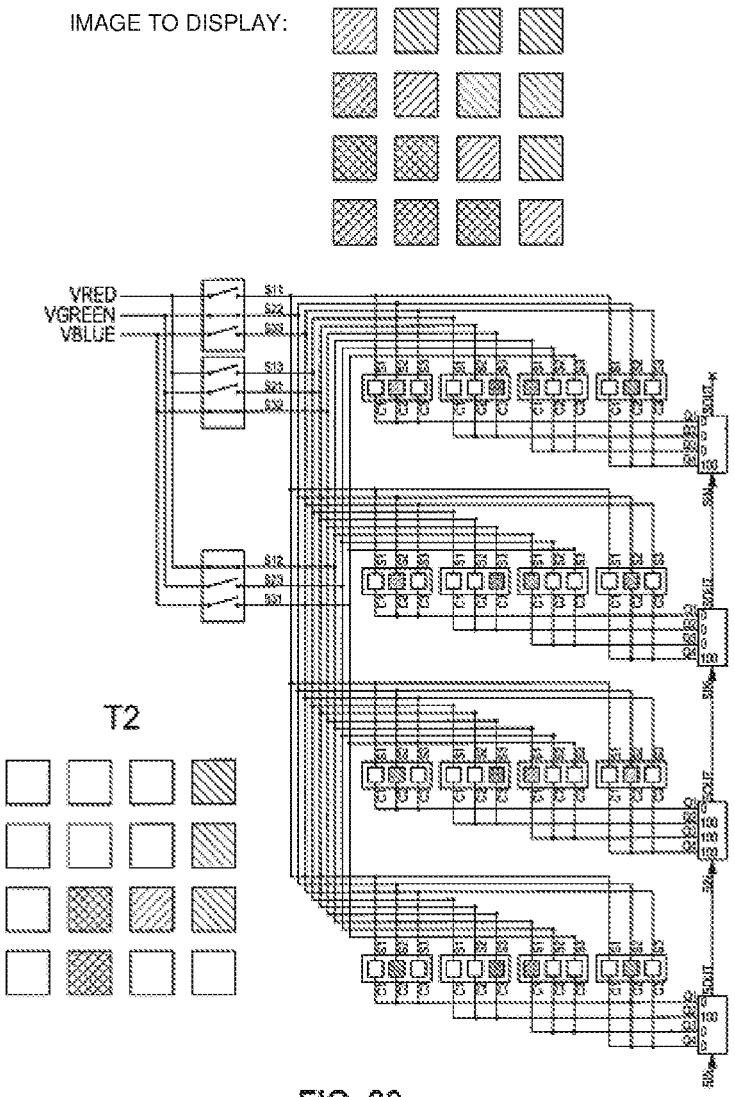
Figure 34:
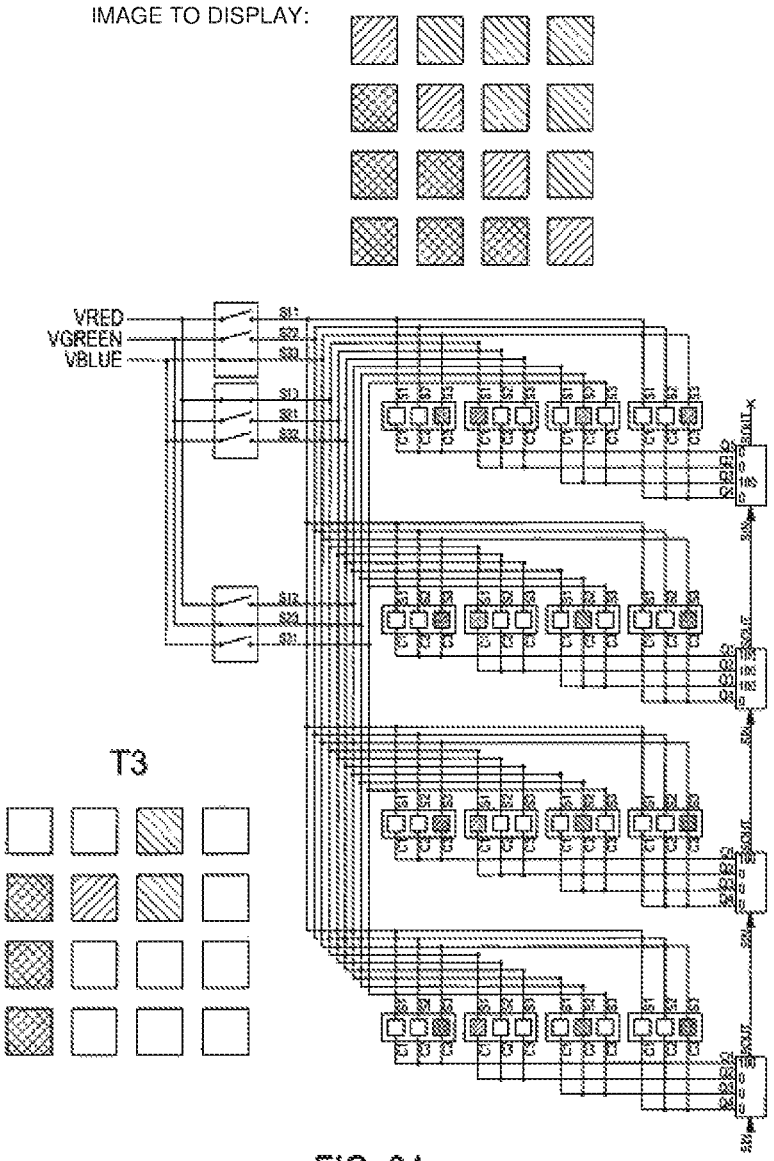

On the contrary, to display any image, such as the one shown in the header of FIGS. 32 to 34, the control means will control sub-pixels, whose selection terminals are activated during the sub-frame considered and whose colour and location in the pixel matrix coincide with the colour of the image at the corresponding location, to diffuse at an intensity of 100%, and the other sub-pixels, whose selection terminals are activated during this sub-frame but whose colours and locations in the matrix do not correspond, to diffuse at an intensity of 0%.

Distribution of Sub-Pixel Groups

In the example of the Figures commented above, the sub-pixels connected to two different selection terminals among those activated simultaneously during the same sub-frame and belonging to two different families are arranged in two adjacent columns (thus during the sub-frame T1, the red sub-pixels of group G1 are arranged in columns and adjacent to the green sub-pixels of group H2), in order to distribute each colour through the pixels of the matrix.

To optimize this distribution, it is advantageously provided for that the sub-pixels of the same group activated during a sub-frame are also distributed in rows and columns so that their nearest neighbour is of a different colour family.

Figure 20:
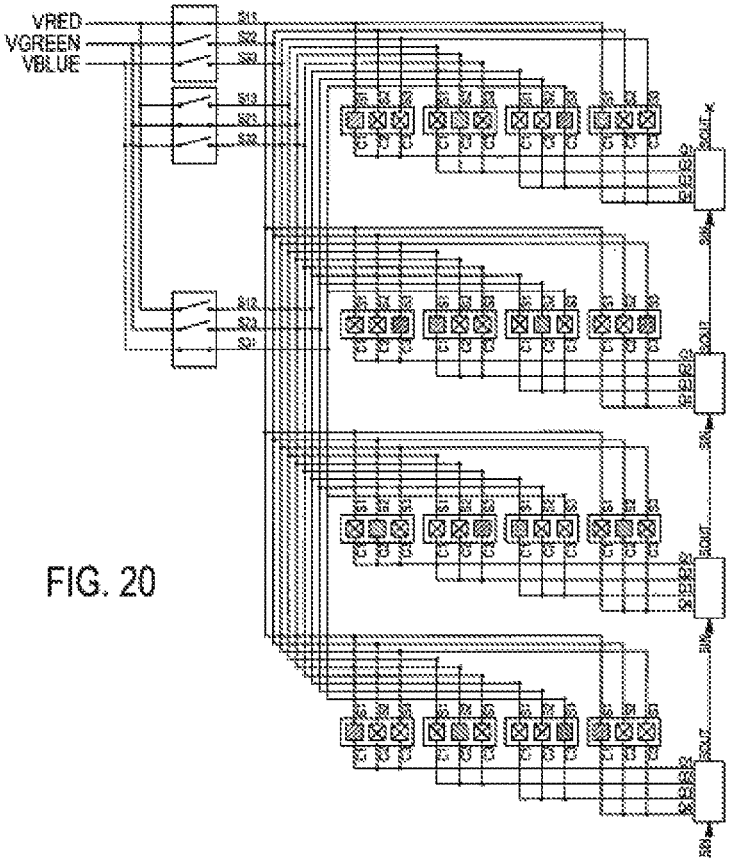
FIGS. 20 to 25 are similar to FIGS. 14 to 19 in that they are made for the pixel wiring of the screen in FIG. 9 according to the invention
Figure 21:
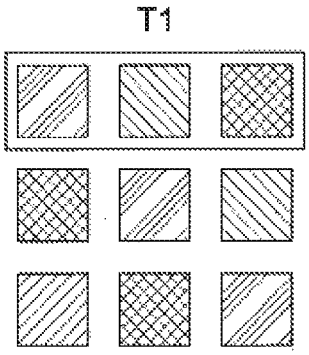
Figure 22:
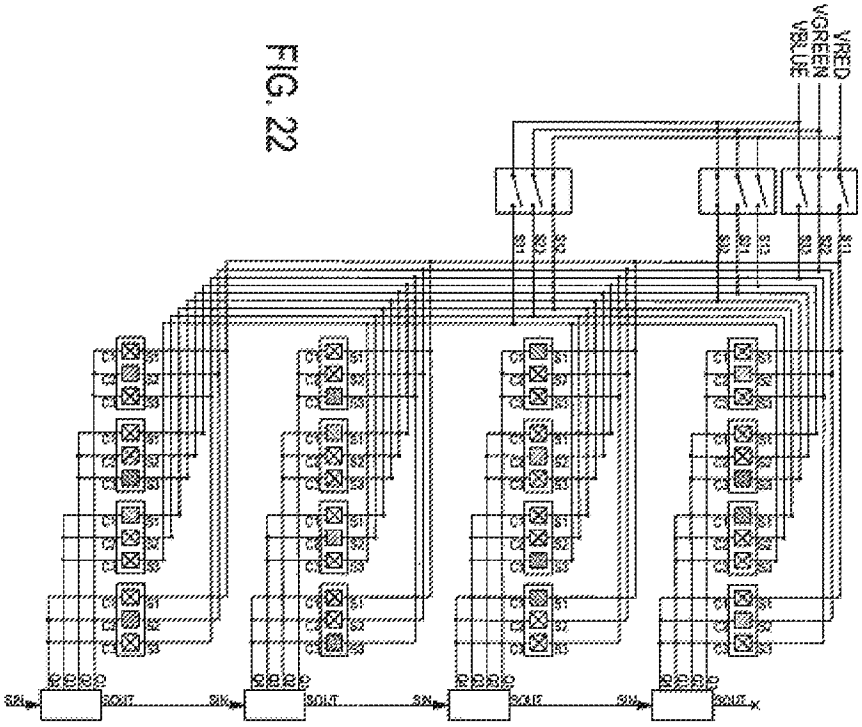
Figure 23:
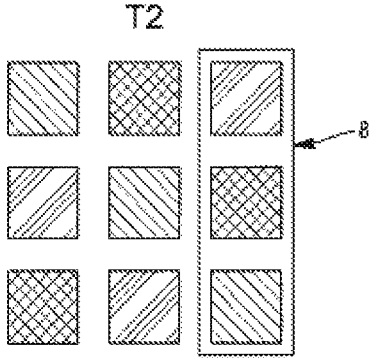
Figure 24:
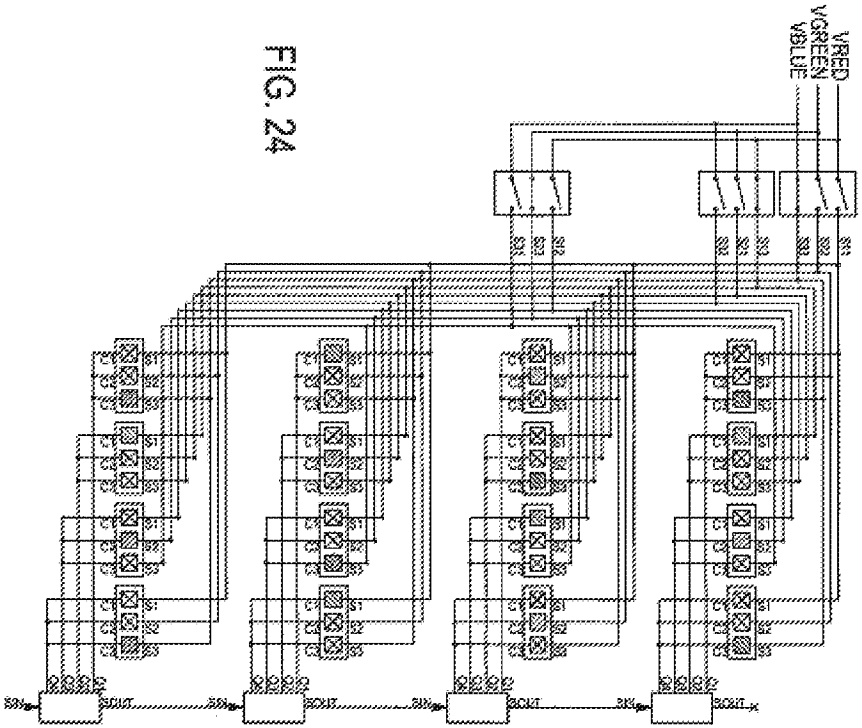
Figure 25:
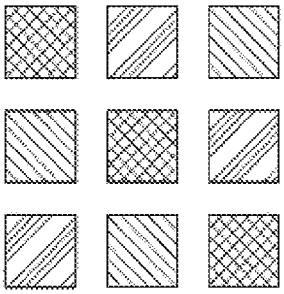
Figure 26:
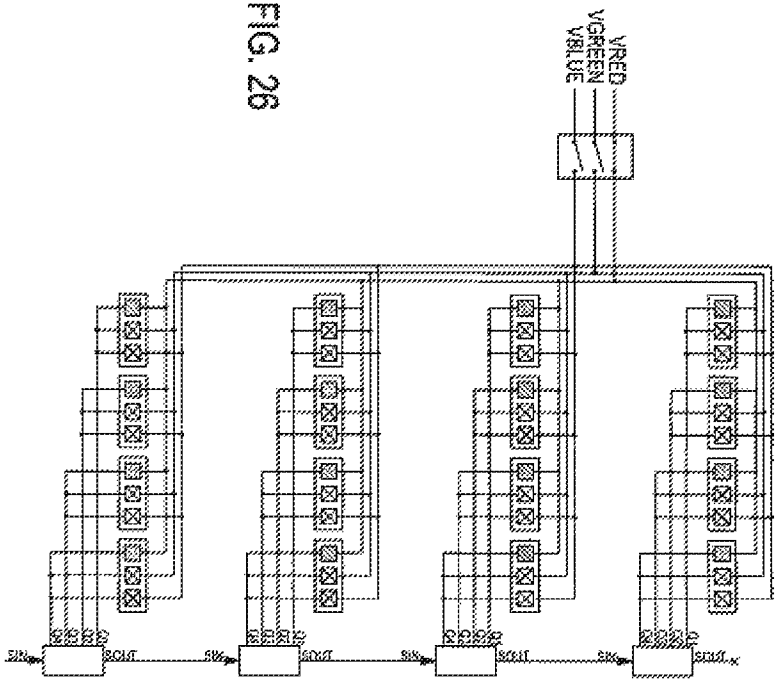
FIGS. 26 to 31 are similar to FIGS. 14 to 19 in that they are made for the pixel wiring of the screen in FIG. 4 according to the prior art
Figure 27:
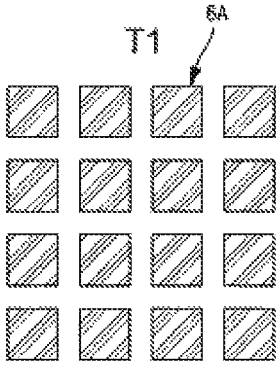
Figure 28:
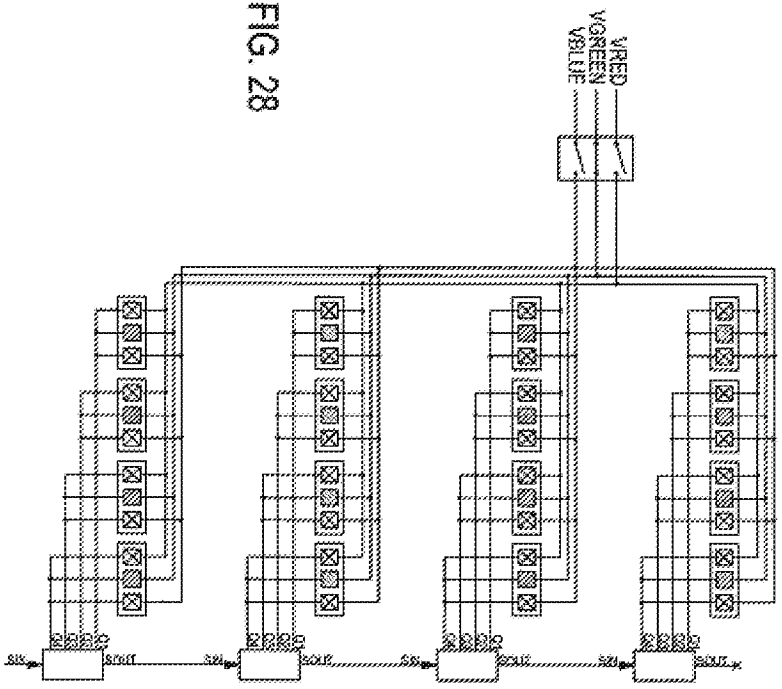
Figure 29:
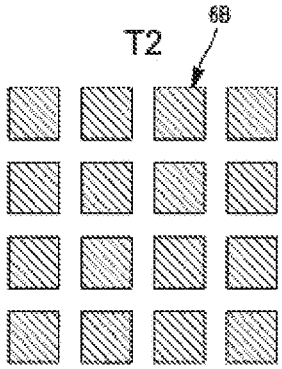
Figure 30:
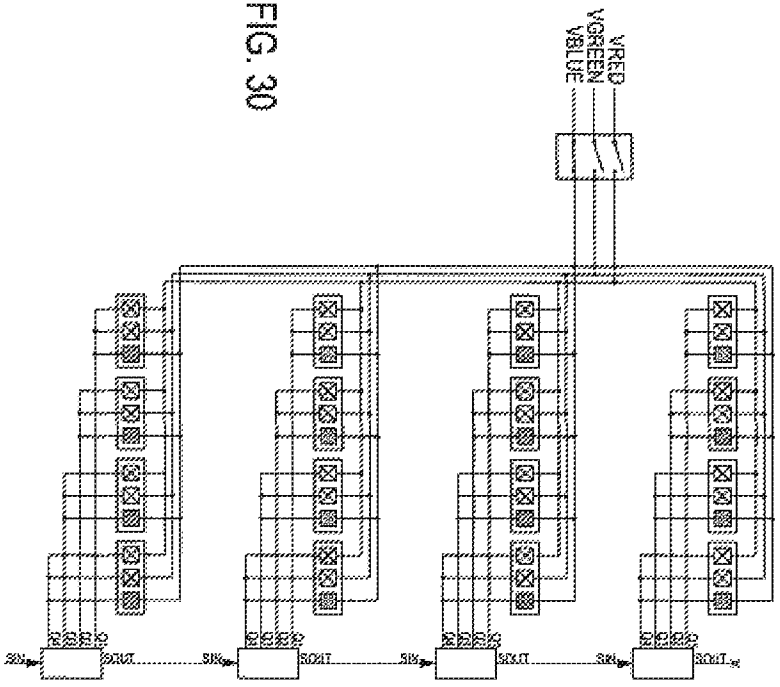
Figure 31:
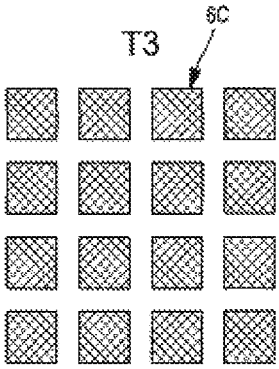

The invention provides for corresponding wiring for these optimized screens shown in FIGS. 20, 22, 24, which follows the same general principles as those described above.

In this optimized screen, the immediate neighbour in row and in column of a sub-pixel that can be activated during the sub-frame considered, is of one and the other of the other colours.

Description of the Screen Operating Method According to the Invention, for any Number N and C It should be reminded here that the invention applies to any matrix screen composed of pixels arranged in rows and columns, each of these pixels being composed of C sub-pixels or groups of sub-pixels of different characteristics and/or colours, belonging to C distinct families noted $F_1$ to $F_C$.

According to the principle of invention, each family $F_X$ of sub-pixels of the screen, with $1 \leq x \leq C$, is subdivided into N.C distinct groups thus constituting $N.C^2$ groups of sub-pixels $G_{X,Y,Z}$, with $N \geq 1$, $1 \leq Y \leq C$ and $1 \leq Z \leq N$, all sub-pixels of the group $G_{X,Y,Z}$ belonging to the same family $F_X$, and each group being associated to a common selection means $S_{X,Y,S}$.

These groups are selected and displayed sequentially during N.C consecutive sub-frames, the C groups $G_{1,Y,Z}$, $G_{2,Y,Z}$ . . . $G_{C,Y,Z}$ being simultaneously selected, by the selection means $S_{1,Y,Z}$, $S_{2,Y,Z}$ . . . $S_{C,Y,Z}$, and displayed during sub-frame $T_{Y,Z}$ Each subset of N pixels of the screen, consisting of N.C sub-pixels belonging to the N.C groups $G_{X,Y,Z}$, such as $1 \leq Y \leq C$ and $1 \leq Z \leq N$, is associated with a control means allowing the status of the sub-pixel belonging to the group $G_{X,Y,Z}$—to be independently controlled during sub-frame $T_{Y,Z}$.

When N=1, $G_{C,Y,Z}$ can be noted in a simplified way $G_{C,Y}$ and $T_{Y,Z}$ noted $T_Y$.

In order to clarify the concept of sub-pixel family or groupings of sub-pixels, some examples are given below.

If a three-colour screen is considered, made up of pixels themselves made up of 3 red, green and blue sub-pixels, it may be contemplated, for example:

To constitute 3 families based on the colour of the sub-pixels; One family for red sub-pixels, another for green and a last one for blue.

Or to create 2 families based on the operating voltage of the sub-pixels: Or, for a technology based on the use of LEDs, the red sub-pixels on one side and on the other, the green & blue sub-pixels requiring a higher supply voltage.

If a screen based on the use of pixels consisting of 4 sub-pixels, red, green, blue and white is considered, 4 families based on the colour of these sub-pixels can be formed.

Lastly, if a screen based on the use of pixels constituted, for example, by 4 sub-pixels is considered, of which 2 are red, one is green and one is blue, the following can be contemplated:

To form as many families as sub-pixels, i.e. four.

To group the two red sub-pixels into a single family and thus constitute three of them.

It is also possible to group sub-pixels into the same family so that the average consumption of each family thus formed is similar.

A first advantage of the invention is illustrated in FIG. 5, which describes the behaviour of a red, green and blue three-colour screen, each pixel of which consists of sub-pixels of these same colours and for which C=3 and N=1.

In this example, there are 3 families of sub-pixels, characterized by the colour displayed; Red, green or blue, and noted $F_1$, $F_2$ & $F_3$ respectively.

According to the invention and for this example, the sub-pixels are organized into 9 groups:

3 groups for the red sub-pixels; $G_{1,1}$, $G_{1,2}$ & $G_{1,3}$, which are displayed during sub-frames $T_1$, $T_2$ &

Similarly, 3 groups for the green sub-pixels; $G_{2,1}$, $G_{2,2}$ & $G_{2,3}$,

And 3 groups for the blue sub-pixels; $G_{3,1}$, $G_{3,2}$ & $G_{3,3}$.

The table in FIG. 5 shows, for each of the 9 groups and depending on the sub-frame $T_1$, $T_2$ or $T_3$, the percentage of sub-pixels displayed, as well as the sum of these percentages within the same family $F_1$, $F_2$ or $F_3$.

Figure 8:
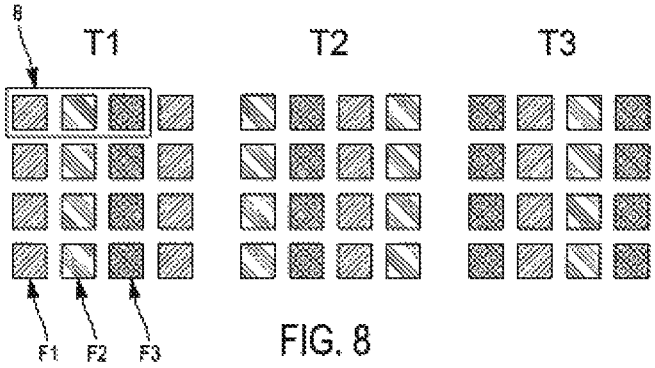
FIG. 8 describes, when C=3 & N=1, a possible organization of sub-pixels during the 3 sub-frames, according to specific embodiments of the invention.

In addition to FIG. 5, FIG. 8 illustrates a possible arrangement of these sub-pixel groups. As can be seen on this figure, during the three sub-frames, each sub-pixel of each pixel will have been selected and displayed, thus allowing a complete image to be composed.

Figure 1:
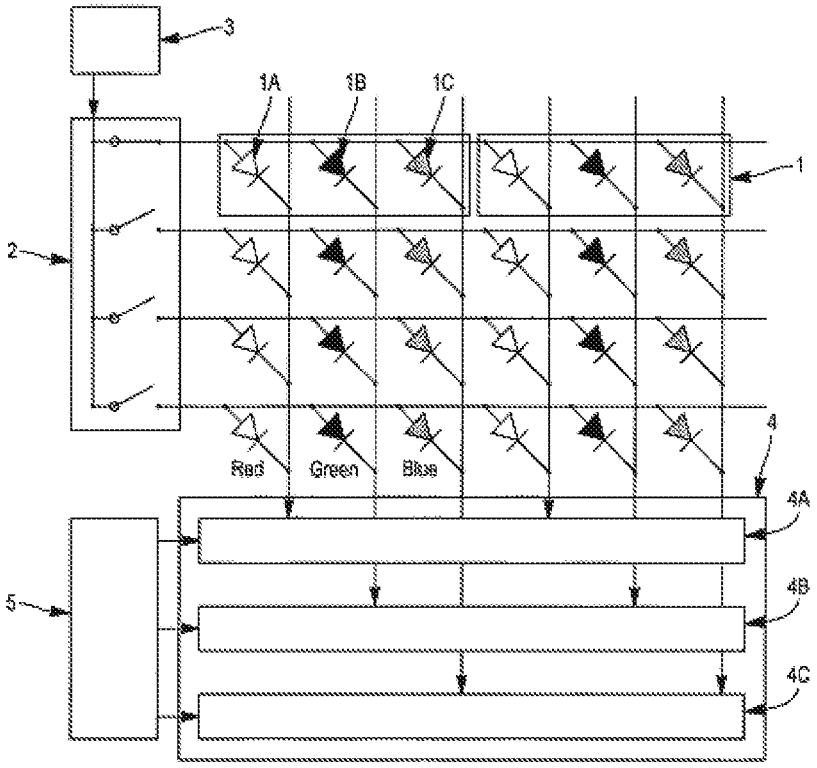
FIG. 1 describes a principle for the construction of spatially multiplexed screens as it can be found in the existing literature.
Figure 2:
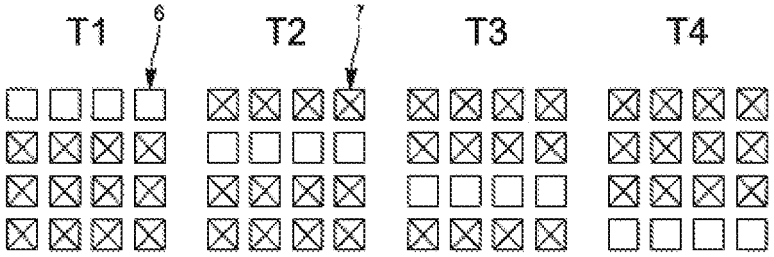
FIG. 2 describes the visual aspect of a 4 by 4 pixel area of a screen according to the principle of FIG. 1 and for the different sub-frames.
Figure 3:
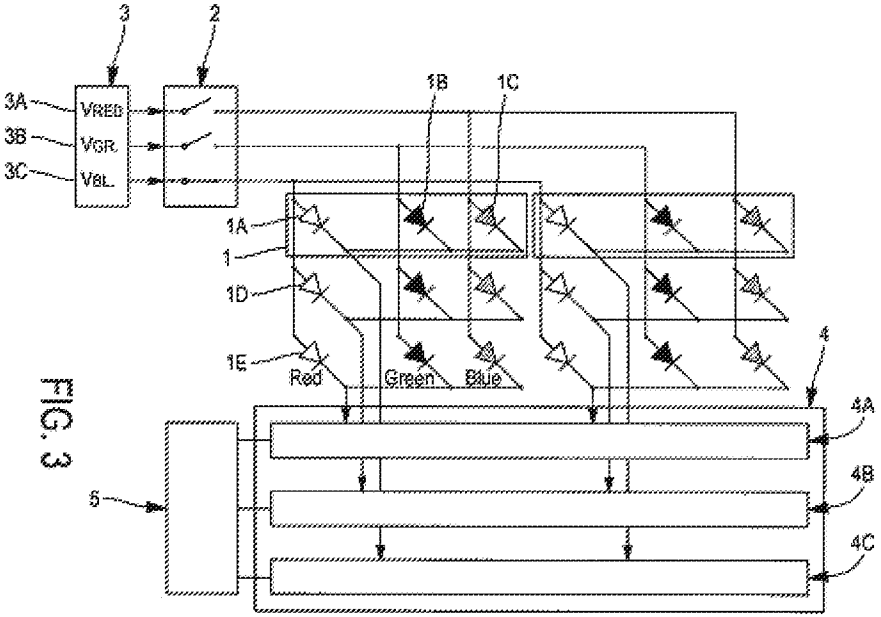
FIG. 3 describes the principle for constructing multiplexed screens in colour components as it can be found in the existing literature.
Figure 4:
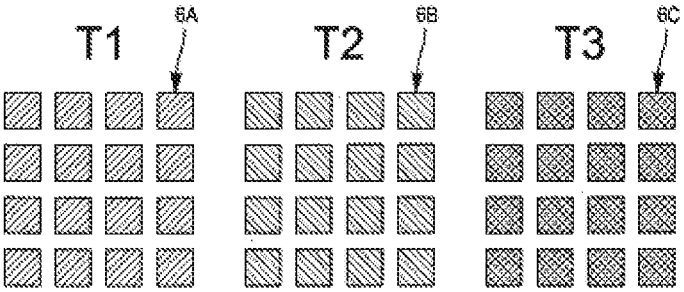
FIG. 4 describes the visual aspect of the pixels of a 4 by 4 pixel area of a screen according to the principle of FIG. 3 and for the different sub-frames.

The table in FIG. 6 presents the same results for the colour component multiplexing method of the prior art as previously described in FIGS. 3 and 4.

FIG. 4 illustrates the distribution and evolution of the state of the screen pixels in relation to the table in FIG. 6.

It can be seen that, if, for previously known addressing modes and principles of implementation and for a screen with identical characteristics, the percentage of sub-pixels displayed in a given family is not constant but is maximum and 100% during a single sub-frame, the addressing mode of the invention allows to ensure that this same percentage remains constant and equal to ⅓ regardless of the sub-frame considered.

If C distinct families are considered, this percentage would be 1/C. This particular property of the method according to the invention brings several advantages compared to the methods of the prior art:

The peak power required to supply each family is divided by C, which allows a supply whose peak power is C times lower to be adequate.

The power, therefore the current and/or voltage, required by each family remains static over time for a given displayed image, which makes it easier to measure without having to use unnecessary filtering means and improves the service life of the electronic components used.

Figure 7:
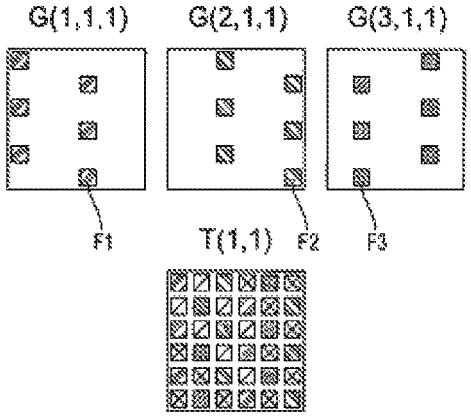
FIG. 7 describes, in the case where C=3 & N=2, and for a particular sub-frame, how 3 groups of sub-pixels combine to produce the sub-image displayed during this sub-frame.

FIG. 7 shows an example of how different groups combine to display the sub-pixel pattern displayed during a sub-frame. More precisely, a portion of a screen with N=1 & C=3 is detailed, showing:

The composition of groups $G_{1,1,1}$ and $G_{2,1,1}$ and $G_{3,1,1}$, relative to families $F_1$, $F_2$ & $F_3$, The result of selecting and displaying these sub-pixel groups during sub-frame $T_{1,1}$.

It can be seen in this figure that for N=2, only half of the pixels are selected and displayed, which is easily deduced from the fact that, according to the invention, all C families of sub-pixels are displayed during C.N sub-frames. Only a 1/N fraction of all pixels is therefore selected and displayed during each sub-frame.

Figure 10:
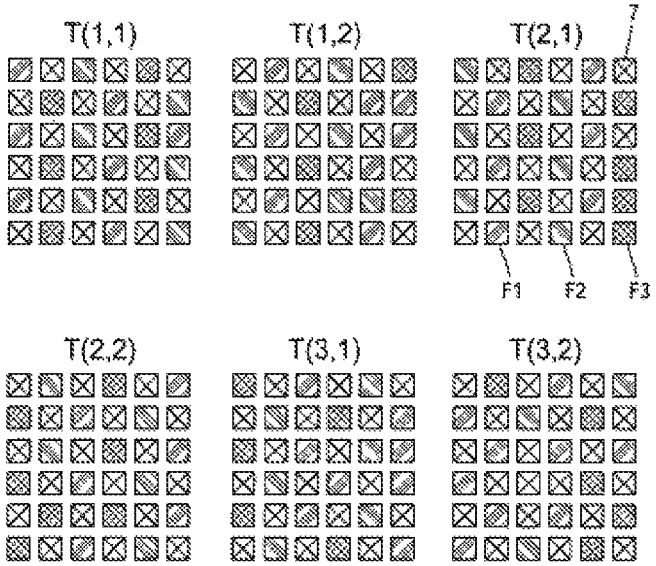
FIG. 10 describes, for the 6 required frames, a possible organization of the sub-pixels in the case where C=3 & N=2.

FIG. 10 shows the 5 other sub-frames $T_{1,2}$, $T_{2,1}$, $T_{2,2}$, $T_{3,1}$ and $T_{3,2}$ associated with the $T_{1,1}$ frame detailed in FIG. 7. In the same way that the latter shows how the groups combine, the groups implemented for these sub-frames can easily be deduced from FIG. 10, since they are made up for each sub-frame of the 3 groups of sub-pixels associated with each family that compose them.

The previous discussion does not take into account the spatial distribution of sub-pixel groups during a frame. However, it is apparent from the examination of FIGS. 8, 9 and 10, that it is advantageous to do so in a way that is specific to the principle of invention.

Thus, the sub-pixel groups $G_{X,Y,Z}$ can be spatially organized in such a way that for any sub-frame $T_{Y,Z}$ considered, any grouping of consecutive N.C pixels considered along a row and/or any grouping of consecutive N.C pixels considered along a column of the screen, contains exactly C pixels of which one sub-pixel is selected and displayed, each being chosen in a different family Fx among the C families of sub-pixels on the screen.

FIG. 8 illustrates, as a first example, a possible distribution in the case where C=3 and N=1, and shows, for each sub-frame, the state of the screen pixels depending on whether a representative of the first family of sub-pixels $F_1$, of the second $F_2$ or of the third $F_3$ is displayed.

In the case illustrated, the pixel groupings 8 mentioned above are evaluated along the screen rows, all screen rows having an identical organization.

Figure 9:
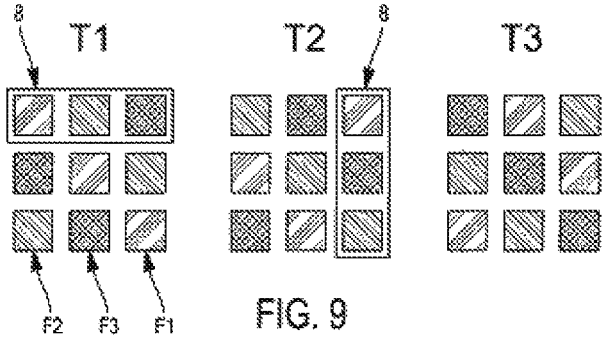
FIG. 9 describes a variant of these embodiments when C=3 & N=1.

FIG. 9 illustrates, as a second example, another possible distribution in the case where C=3 and N=1, with pixel groupings 8 being evaluated along the rows and columns of the screen.

Lastly, FIG. 10 illustrates, by way of example, a possible distribution in the case where C=3 and N=2.

Another advantage of the principle of the invention can be seen in these three figures. Indeed, the spatial distribution of sub-pixel groups ensures that, for any sub-frame displayed, the local average of the displayed information remains representative of the complete image.

Thus, for example, any shooting of a three-colour screen with a short exposure time, even if it may not reflect the same quality as the full image, never results in an image of a single screen colour as can be commonly observed with known methods. Even if the image is displayed dynamically over several sub-frames, any instant image remains representative of the complete image and the addressing method of the invention can therefore be described as quasi-static.

In an advantageous way, and particularly in the case where N>1, for any sub-frame $T_{Y,Z}$ considered among the N.C possible, the sub-pixel groups $G_{X,Y,Z}$ are organized in such a way that any pixel of which a representative among the C families Fx of sub-pixels is selected and displayed, is followed, along the rows or columns or the rows and columns of the screen, by N−1 pixels for which none of the sub-pixels is selected.

A particular organization of the different sub-pixel groups also makes it possible to distribute them temporally in an advantageous way. Thus, and according to this particular embodiment, the sub-pixel groups $G_{X,Y,Z}$ are organized in such a way that any pixel of which a representative among the C families Fx of sub-pixels is selected and displayed during a given sub-frame is not displayed during the following N−1 sub-frames.

FIG. 10 illustrates a possible arrangement of these preferred embodiments in the case where C=3 and N=2, the first criterion being applied along the rows and columns of the screen.

In the case of a conventional matrix organization, each pixel is surrounded by 8 close neighbours as seen, for example, in FIGS. 9 & 10.

In the case where C=3 & N=1, a particular embodiment allows, within the framework of the invention, to bring additional particular advantages. This is described by FIG. 11. The rows and columns of the screen are spatially organized in such a way that the pixels of a particular row are offset by ½ horizontal pitch between each pixel HP with respect to those of the previous row.

In this configuration, each pixel is surrounded by 6 nearest neighbours. The 9 sub-pixel groups $G_{X,Y}$ are spatially organized in such a way that for any given sub-frame $T_Y$, any grouping of 3 neighbouring pixels displays a representative of each of the 3 sub-pixel families on the screen.

Figure 11:
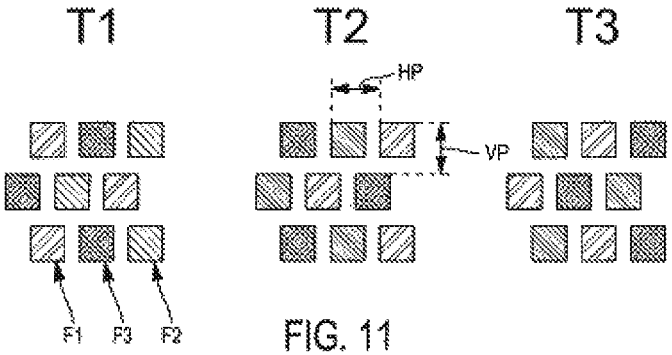
FIG. 11 describes a particular embodiment in the case where C=3 & N=1.

FIG. 11 describes a first possible organization, a second one also being described by changing the $F_2$ and $F_3$ families in the same figure.

In this particular embodiment, it is advantageous to set a precise ratio between the horizontal pitch HP between each column of pixels and the vertical pitch VP between each row of pixels. Indeed, if the distance between two pixels of the same row is given by HP, the distance R between a pixel and the neighbouring pixels of an adjacent row is given by:

$$R^2 = VP^2 + \frac{HP^2}{4}$$

This distance R can be made equal to HP if:

$$VP = \frac{\sqrt{3}}{2} HP$$

In this particular configuration, the pixels are arranged in a regular hexagonal pattern, with any 3 neighbouring pixels forming an equilateral triangle.

The density $D_H$ of pixels is then given by:

$$D_H = \frac{4\sqrt{3}}{9R^2}$$

For purposes of comparison, the average distance R between pixels of a conventional matrix organization is given by:

$$R = P\frac{1+\sqrt{2}}{2}$$

P being equal to the vertical and horizontal pitch between pixels.

The density $D_R$ of pixels expressed as a function of R is then given by:

$$D_R = \frac{(1+\sqrt{2})^2}{4R^2}$$

The ratio $D_R/D_R$ is thus, for an identical average distance between pixels, equal to:

$$\frac{D_H}{D_R} = \frac{16}{9}\frac{\sqrt{3}}{(1+\sqrt{2})^2} \sim 0{,}5283$$

This, in other words, indicates that to obtain the same average distance between pixels, the pixel density, and therefore the overall cost of the screen, can be reduced proportionally.

In all the above, the nature of the sub-pixels constituting the $F_1$, $F_2$, . . . $F_C$ families can be any and combine these sub-pixels according to their colour, technology, operating voltage or any other characteristic.

The invention has a particular application in the case where this distribution of C families is done according to colour. Two particular cases of embodiment of the addressing principle of the invention are of practical interest in this case:

In the case where C=3 and the sub-pixels of families $F_1$, $F_2$ & $F_3$ being respectively red, green and blue. This configuration thus allows any colour images to be displayed.

In the case where C=4 and the sub-pixels of families $F_1$, $F_2$, $F_3$, $F_4$ being respectively red, green, blue and white. This configuration also allows any colour images to be displayed and to be able to improve the overall luminance and performance of the screen by adding white light when the image to be displayed allows it.

The invention also has a particularly advantageous application in the case of LED-based screens.

In this case, each pixel is made up of sub-pixels made up of light-emitting diodes connected as follows:

All the anodes of the light-emitting diodes constituting the sub-pixels of the same group $G_{X,Y,Z}$ are connected to each other and to the same output of the selection means 2, counting $N.C^2$, allowing these groups to be selected sequentially during N.C consecutive sub-frames at the rate of C distinct groups $G_{1,Y,Z}$, $G_{2,Y,Z}$ . . . $G_{C,Y,Z}$ by sub-frame $T_{Y,Z}$, Each output of the control circuits 4, allowing to control the current flowing in the diodes connected to it, is also connected to the C.N cathodes of the light-emitting diodes constituting the C.N sub-pixels of N distinct pixels, each sub-pixel belonging to a distinct $G_{X,Y,Z}$ group characterized by $1 \leq Y \leq C$ and $1 \leq Z \leq N$.

FIG. 12 provides a better understanding of this arrangement in the case where N=2 & C=3. It describes a 2-row, 6-pixel 1 portion of such a LED screen. The corresponding diagram will be repeated as many times vertically and horizontally as necessary to build a module of the screen and as a result a complete screen.

FIG. 10 describes, for a portion of 6 rows of 6 pixels, the state of the sub-pixels during the various sub-frames.

It is useful to refer to it to better understand the diagram of FIG. 12.

The tables in FIG. 13 also show for each family F1, F2 and F3, and each pixel in the relevant area of the screen, to which group the different sub-pixels belong.

There are $2.3^2$ groups, or 18, of which 2.3 or 6, per family of sub-pixels. The 3 selection circuits 2 in FIG. 12 therefore have 18 outputs, labelled $S_{X,Y,Z}$, the 3 outputs $S_{1,Y,Z}$, $S_{2,Y,Z}$ and $S_{3,Y,Z}$ being simultaneously activated during the frame $T_{Y,Z}$, thus allowing the control, by means of the control circuits 4, of the LEDs whose anodes are connected to them.

It is clear from this particular case of device that the principle of the invention leads to the use of $N.C^2$ selection means, against N and C respectively in previously known devices.

From the point of view of the cathodes of the LEDs constituting the sub-pixels, it is useful to take a particular example to better understand how the principle of the invention can be applied. For example, the 3 cathodes of the 3 sub-pixels of the pixel belonging to the first row & first column, therefore belonging to the groups $G_{1,1,2}$, $G_{2,2,1}$ & $G_{3,3,1}$, as well as the 3 cathodes of the 3 sub-pixels of the neighbouring pixel, therefore belonging to the groups $G_{1,1,2}$, $G_{2,2,2}$ & $G_{3,3,2}$, are linked together and controlled by a single output of control circuit 4.

A single output of control circuits 4 therefore makes it possible to control N.C. sub-pixels.

The invention claimed is:

1. A matrix screen for displaying multiplexed colour images, the screen being composed of pixels arranged in a matrix and each consisting of different types of optoelectronic devices respectively capable of diffusing different basic colours when an electrical excitation is applied to the optoelectronic devices, each optoelectronic device being connected on the one hand to an electrical excitation source corresponding to the colour the optoelectronic device diffuses, called the colour source, and on the other hand to a control means configured to vary the intensity of the diffusion of the corresponding colour, the optoelectronic devices diffusing the same colour being connected to the corresponding colour source via at least one selection module of a colour source, wherein the screen comprises several selection modules each connected to at least one colour source, in that each selection module comprises different selection terminals, a single selection terminal per selection module being activated during the same screen operating phase or sub-frame, and in that the optoelectronic devices of the screen belonging to the same colour family, such as diffusing the same colour, are distributed among different groups, and meet the following characteristics:

the optoelectronic devices of the same group are all connected to the same corresponding colour selection terminal of the same selection module, the selection terminals of a group of each colour family can be activated simultaneously in order to activate optoelectronic devices diffusing all possible colours during the same sub-frame, wherein for a number of base colours C, C being a positive integer, and a multiplexing rate N, N being a positive integer, the screen has a total number of $N*C^2$ groups in which the optoelectronic devices of the screen are distributed and a total number of $N*C^2$ selection terminals connected respectively to the $N*C^2$ groups and distributed in a number C*N of selection modules.

2. The device according to claim 1, wherein optoelectronic devices of the same pixel and belonging to different groups are connected to the same control means.

3. The device according to claim 1, wherein for a number of base colours C, C being a positive integer, and a multiplexing rate N, N being a positive integer, the optoelectronic devices of a number of N pixel(s) are connected to the same control means.

4. The device according to claim 1, wherein the optoelectronic devices of the same group and connected to the same selection terminal are arranged according to a column or a row of the pixel matrix constituting the matrix screen, the optoelectronic devices connected to two different selection terminals among those activated simultaneously during the same sub-frame and belonging to two different families are arranged along two adjacent columns or rows.

5. The device according to claim 1, wherein the optoelectronic devices of different groups connected to different selection terminals among those activated simultaneously during the same sub-frame are arranged in periodic alternation from one group to another along the columns and/or rows of the matrix constituting the screen.

6. A matrix screen according to claim 1, wherein the horizontal pitch HP of the pixels along the screen rows and the vertical pitch VP of the pixels along the screen columns are such that $$VP = \frac{\sqrt{3}}{2} HP$$

and that any grouping of 3 neighbouring pixels forms an equilateral triangle.

7. The matrix screen according to claim 6, wherein the basic colours of the screen are 3 in number, C=3, and are respectively red, green and blue.

8. The matrix screen according to claim 6, wherein the basic colours of the screen are 4 in number, C=4, and are respectively red, green, blue and white.

9. A matrix display according to claim 1, wherein an optoelectronic device is a light-emitting diode whose anode is connected to the corresponding selection terminal and the cathode to the corresponding control means.

10. A display device comprising one or more screens assembled together to form the display device, made according to claim 1.

11. A method of manufacturing multiplexed matrix screen for displaying colour images according to claim 1, comprising:

a step of wiring several selection modules each to at least one colour source, —a step of wiring optoelectronic devices to the same corresponding colour selection terminal of the same selection module, these devices connected to the same selection terminal forming a group, and a step of configuring the selection terminals of a group of each family that can be activated simultaneously in order to activate optoelectronic devices that diffuse all possible colours during the same sub-frame, wherein for a number of base colours C, C being a positive integer, and a multiplexing rate N, N being a positive integer, $N*C^2$ groups of optoelectronic devices are formed and optoelectronic devices of the same group are connected to the same terminal, the screen being sized with a total number of $N*C^2$ selection terminals and a number C*N selection modules.

* * * * *